US006206651B1

(12) United States Patent
Klaus et al.

(10) Patent No.: US 6,206,651 B1
(45) Date of Patent: Mar. 27, 2001

(54) OIL PUMP FOR AN INTERNAL COMBUSTION ENGINE HAVING TOOTHED WHEELS

(75) Inventors: Heinz Klaus, Vienna; Gerald Buha, Steyr, both of (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 0 days.

(21) Appl. No.: 09/257,249

(22) Filed: Feb. 25, 1999

(30) Foreign Application Priority Data

Feb. 26, 1998 (AT) ..... A 348/98

(51) Int. Cl.[7] ..... F04B 49/00; F04B 23/04
(52) U.S. Cl. ..... 417/287; 417/427
(58) Field of Search ..... 417/287, 286, 417/253, 288, 426, 427, 428

(56) References Cited

U.S. PATENT DOCUMENTS 3,068,795 * 12/1962 Lauck ..... 417/287
3,385,217 * 5/1968 Bles ..... 417/287
4,002,027 * 1/1977 Eley et al. ..... 60/430
5,094,597 * 3/1992 Takai et al. ..... 417/428

* cited by examiner

*Primary Examiner*—Charles G. Freay
(74) *Attorney, Agent, or Firm*—Dykema Gossett PLLC

(57) ABSTRACT

The invention relates to an oil pump for an internal combustion engine with at least one pair of toothed wheels which are in mutual engagement, at least one intake port and at least one outlet port. An improved supply of oil at reduced driving power can be achieved with at least two pairs of toothed wheels; a first common shaft, which a first toothed wheel of each pair of toothed wheels is arranged, and means are provided to charge the individual pairs of toothed wheels with oil depending on the required quantity of conveyed oil.

5 Claims, 2 Drawing Sheets

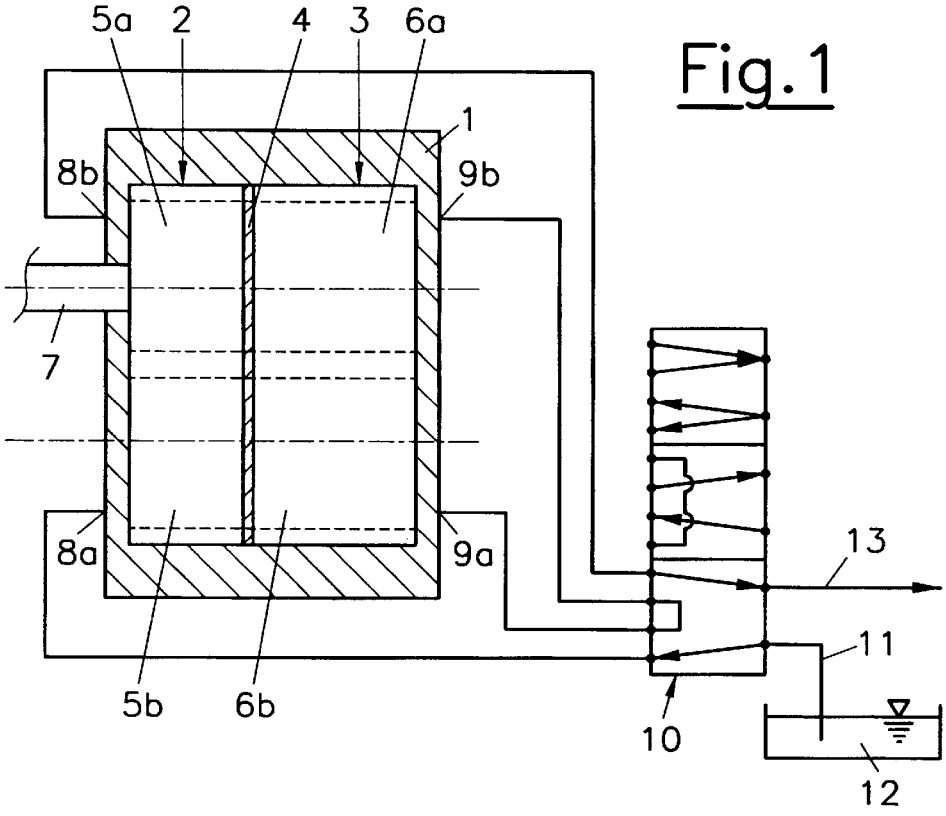
Fig.1
Fig.3
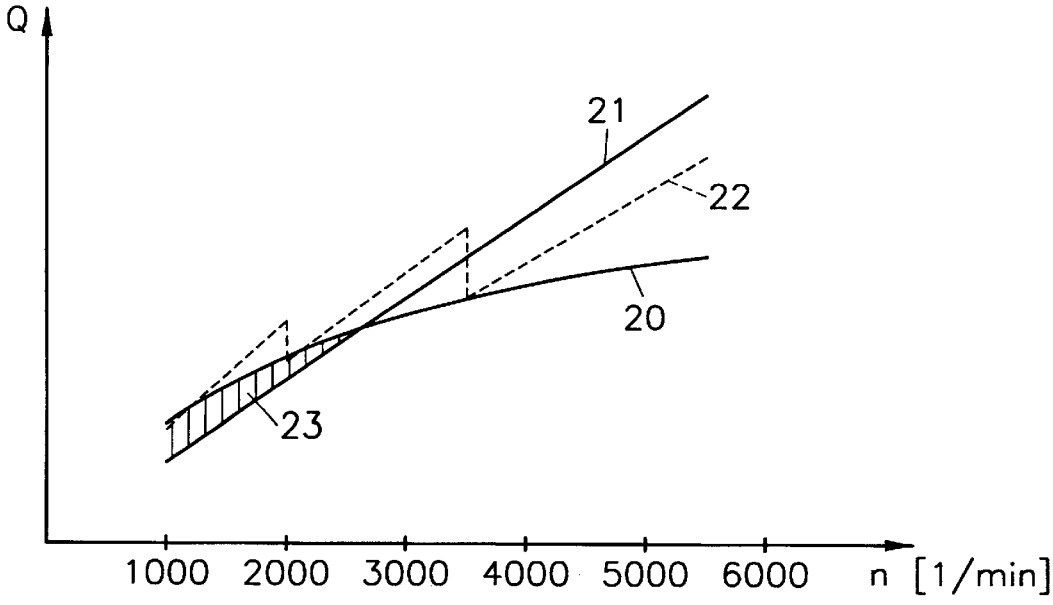

OIL PUMP FOR AN INTERNAL COMBUSTION ENGINE HAVING TOOTHED WHEELS

BACKGROUND OF THE INVENTION

The present invention relates to an internal combustion engine with internal combustion with at least one pair of toothed wheels which are in mutual engagement, at least one intake port and at least one outlet port.

DESCRIPTION OF THE PRIOR ART

Oil pumps for internal combustion engines which are intended for motor vehicles in particular are usually arranged as gear pumps. They consist of a pair of toothed wheels which are in mutual engagement, with the conveyance of oil being caused by the displacement effect of the teeth. The conveying effect of such gear pumps substantially depends linearly on the speed of rotation with which these gear pumps are driven. As the drive is generally performed directly by way of the internal combustion engine, the pump output is therefore substantially proportional to the rotational speed of the internal combustion engine. The oil quantity required for the operation of the internal combustion engine, however, is not linearly dependent on the rotational speed. This means that in a number of speed ranges, namely particularly at low engine speeds, there is a danger of a lack of supply with oil, whereas in other engine speed ranges a relatively large quantity needs to be removed by way of pressure control valves.

SUMMARY OF THE INVENTION

It is the object of the present invention to improve an oil pump of the kind mentioned above in such a way that these disadvantages are avoided. It is the object of the present invention in particular to reduce the energy requirements for the drive of an oil pump in order to increase the total efficiency of internal combustion engines. These objects are achieved in accordance with the invention with at least two pairs of toothed wheels, a first common shaft on which a first toothed wheel of each pair of toothed wheels is arranged and means are provided in order to charge with oil the individual pairs of toothed wheels depending on the required quantity of conveyed oil.

In the case of the solution in accordance with the invention it is possible to adjust the oil pump output in certain stages to the actual demand. Although the dependence of the conveying quantity on the rotational speed is principally still retained in the solution in accordance with the invention, the factor of proportionality can be changed.

The solution in accordance with the invention is arranged in such a way that in the case of a relatively low demand for oil only one pair of toothed wheels will assume the actual conveyance. In the case of maximum oil demand all pairs of toothed wheels are used in parallel with one another for the conveyance.

In order to prevent no-load losses to the highest possible extent, it is advantageous that each pair of toothed wheels is assigned an own intake port and an own outlet port and that a valve is provided in order to optionally connect at least one intake port with the associated outlet port. The idly running pair(s) of toothed wheels is/are operated in circulation and substantially pressureless, so that cooling and lubrication are ensured and that with the exception of frictional losses no driving torque is required for the movement of the toothed wheels.

In a particularly simple embodiment of the present invention it is provided that a control valve is provided in order to optionally supply the individual pairs of toothed wheels with oil and that the oil pressure in the outlet line is used as a control pressure for said control valve. As an alternative it may also be provided that an electronic control apparatus is provided in order to charge with oil the individual pairs of toothed wheels. The oil pump in accordance with the invention can be controlled in an intelligent manner by the engine management. In this way it is also possible to cover any additionally required oil demand which can result from an apparatus for changing the setting angle of a camshaft for example.

There is an increase in the number of possibilities for adjustment in that the individual pairs of toothed wheels have a different width. In an oil pump with two pairs of toothed wheels, for example, this allows achieving three different characteristic performance curves.

BRIEF DESCRIPTION OF THE DRAWINGS

The present invention will now be explained in closer detail by reference to the embodiments shown in the figures, wherein:

FIG. 1 schematically shows an embodiment of the present invention;

FIG. 3 shows a diagram in which the conveyed quantity is entered over the drive speed.

DETAILED DESCRIPTION OF THE PREFERRED EMBODIMENTS

Figure 2:
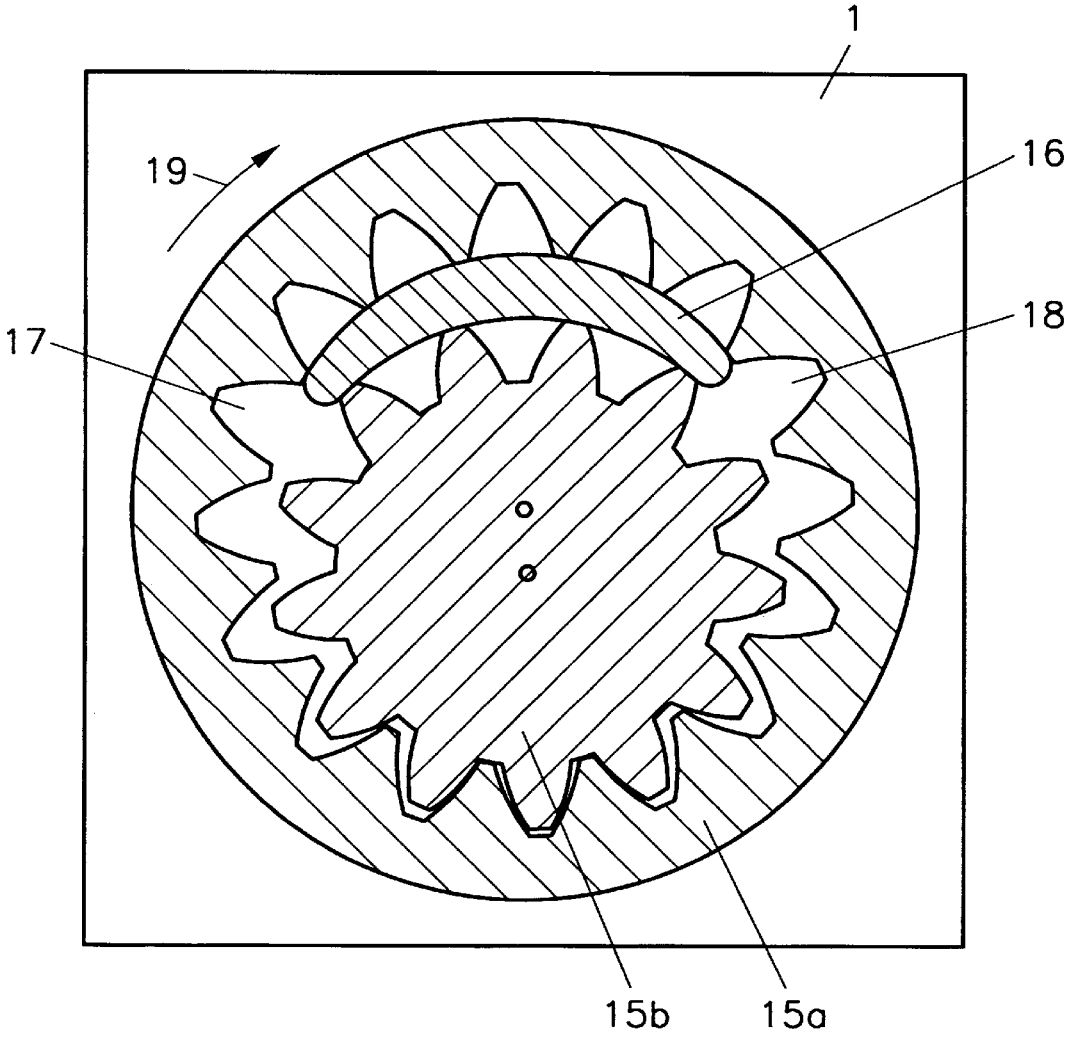
FIG. 2 shows a sectional view through an oil pump in accordance with the invention.

The oil pump in accordance with the invention consists of a housing 1 in which two chambers 2, 3 are provided which are separated from one another by a separating wall 4. A pair of toothed wheels is disposed in the first chamber, which pair consists of the toothed wheels 5*a*, 5*b*, whereas a pair of toothed wheels consisting of the toothed wheels 6*a*, 6*b* is provided in the second chamber 3. The toothed wheels 5*a*, 6*a* are attached to a common shaft 7 which is also used for the drive of the pump. A first intake port 8*a* is in connection with chamber 2, whereas a second intake port 9*a* is in connection with chamber 3. A first outlet port 8*b* leads away from the chamber 2, whereas a second outlet port 9*b* leads away from the second chamber 3. A control valve 10 is provided to switch over to the different operating modes of the oil pump.

In a first position of the control valve 10, which is arranged as a sliding valve, an intake line 11, which leads to a reservoir 12 such as an oilpan of an internal combustion engine (not shown), is connected with the first intake port 8*a*. The first outlet port 8*b* is placed in connection with an oil supply line 13 which leads to the components to be lubricated. Furthermore, the second intake port 9*a* and the second outlet port 9*b* are mutually connected in this position of the valve 10, so that the pair of toothed wheels 6*a*, 6*b* is operated in short circuit.

In a second position of the valve 10 the switching of the first intake port 8*a* and the outlet port 8*b* and the second intake port 9*a* and the outlet port 9*b* is reversed. Therefore, the pair of toothed wheels 5*a*, 5*b* is operated in short circuit while the oil conveyance occurs by way of the pair of toothed wheels 6*a*, 6*b*.

As the pair of toothed wheels 6*a*, 6*b* is provided with a wider arrangement than the pair of toothed wheels 5*a*, 5*b*, the output of the oil pump is increased in this state.

In a third switching position of valve 10 the two intake ports 8*a*, 9*a* are connected with the intake line 11 and both outlet ports 8*b*, 9*b* are connected with the oil supply line 13. The quantity of oil conveyed by the pump is the highest in this state.

The control of the valve 10 can occur in accordance with the invention in such a way that in the case of low oil pressure the control valve 10 will be in the third position in any case. When exceeding a first pressure threshold the changeover to the second state can occur. When this pressure is reached again, a changeover to the third state can occur. As an alternative to this, however, the changeover of valve 10 can also be effected by the engine management. This leads to the additional advantage that during cold starting for example or in any other operating state where a high quantity of conveyed oil is required, valve 10 can be brought to the third position. Even if additional oil consumer sources such as certain actuating apparatuses are triggered, the engine management can already make available, in an anticipatory manner, a higher oil pressure.

FIG. 2 shows a possible embodiment of an oil pump in accordance with the invention. An internal toothed wheel 15*a* and a toothed wheel 15*b* which is in engagement with said internal toothed wheel 15*a* are provided in a housing 1. Toothed wheels 15*a* and 15*b* are arranged eccentrically with respect to one another in order to be in engagement. A guide element 16 is provided in the gap between the toothed wheels 15*a* and 15*b*, which guide element separates the intake chamber 17 from the outlet chamber 18. It is assumed that the toothed wheels 15*a*, 15*b* rotate in the direction of arrow 19.

FIG. 3 shows the oil demand and the quantity of conveyed oil of an oil pump according to the state of the art and of an oil pump according to the present invention, entered over the rotational speed n of the internal combustion engine. Curve 20 corresponds to the under proportionally increasing oil demand of the internal combustion engine. The unbroken straight line 21 corresponds to the conveyed oil quantity of a known oil pump. The stepped line 22, which is shown as a broken line, corresponds to the characteristic curve of an oil pump in accordance with the invention. FIG. 3 shows that the output of the known oil pump pursuant to the characteristic curve 21 increases substantially more rapidly than the oil demand (curve 20). Although there is a range 23 in the range of low speeds in which the conveyed oil quantity is too low with the known pump, the conveyed oil quantity at higher speeds is substantially higher than the actual demand. This means that a relatively large quantity of oil has to be removed by way of the pressure control valve and that consequently a relatively large amount of driving power of the oil pump is uselessly consumed in this speed range. In contrast to this, the characteristic curve 22 of the oil pump in accordance with the invention is above curve 22, which indicates the oil demand, in all speed ranges. The oil supply of the engine is thus improved as compared with the state of the art. Nevertheless, the oil quantity to be removed in the upper speed range is considerably lower than than the one in the known oil pump. FIG. 3 shows that the switching times at which the output of the oil pump is reduced is chosen at 2000 revolutions and at 3500 revolutions. As has already been explained above, it is not necessary to make the switching times dependent on the engine speed. Instead, they can be chosen depending on a plurality of operational parameters.

The present invention allows providing an oil pump which, on the one hand, ensures a better supply of the engine with oil and, on the other hand, has a lower power requirement.

What is claimed is:

1. An oil pump for an internal combustion engine, comprising:

at least one intake port and at least one outlet port, at least two pairs of toothed wheels are provided, the wheels of each pair being in mutual engagement, a first common shaft is provided on which a first toothed wheel of each pair of toothed wheels is arranged, means to pump oil and a control valve are provided in order to supply, with oil, the individual pairs of toothed wheels depending upon the required conveyed oil quantity, the oil pressure in the outlet line is used as control pressure for said control valve, a first pair of toothed wheels has a first intake port and a first outlet port;

a second pair of toothed wheels has a second intake port and a second outlet port;

said control valve switches to and from different operating positions;

said different operating positions are comprised of
a first position,
a second position and
a third position;

in said first position said intake line is connected with said first intake port and said oil supply line is connected to said first outlet port, wherein said first set of toothed wheels receive oil supplied directly and said second set of toothed wheels operate in short circuit receiving oil supplied by said second outlet port of said second set of toothed wheels;

in said second position, said intake line is connected with said second intake port and said oil supply line is connected to said second outlet port, wherein said second set of toothed wheels receive oil supplied directly and said first set of toothed wheels operate in short circuit receiving oil supplied by said first outlet port of said first set of toothed wheels; and in said third position, said intake line is connected with said first and said second intake ports and said oil supply line is connected to both said first and said second outlet ports, wherein both said first and second sets of toothed wheels receive oil supplied directly.

2. An oil pump according to claim 1, wherein two mutually separated chambers are provided and each receives one pair of toothed wheels.

3. An oil pump according to claim 1, wherein each pair of toothed wheels has a separate intake port and a separate outlet port and said control valve is provided in order to either connect at least one intake port with the associated outlet port or interrupt a set connection.

4. An oil pump according to claim 1, wherein the individual pairs of toothed wheels have a different width.

5. An oil pump according to claim 1, wherein one toothed wheel of a pair of toothed wheels is provided with an internal toothing.

* * * * *